US011053735B2

(12) United States Patent
Sonzini

(10) Patent No.: US 11,053,735 B2
(45) Date of Patent: Jul. 6, 2021

(54) ELECTROMECHANICAL ACTUATOR AND HOME AUTOMATION INSTALLATION COMPRISING SUCH AN ACTUATOR

(71) Applicant: SOMFY ACTIVITES SA, Cluses (FR)

(72) Inventor: Marc Sonzini, Allinges (FR)

(73) Assignee: SOMFY ACTIVITES SA, Cluses (FR)

( * ) Notice: Subject to any disclaimer, the term of this patent is extended or adjusted under 35 U.S.C. 154(b) by 0 days.

(21) Appl. No.: 16/759,479

(22) PCT Filed: Nov. 16, 2018

(86) PCT No.: PCT/EP2018/081637
§ 371 (c)(1),
(2) Date: Apr. 27, 2020

(87) PCT Pub. No.: WO2019/105771
PCT Pub. Date: Jun. 6, 2019

(65) Prior Publication Data

US 2020/0332596 A1 Oct. 22, 2020

(30) Foreign Application Priority Data

Dec. 1, 2017 (FR) ..... 1771298

(51) Int. Cl.
*E06B 9/72* (2006.01)
*E06B 9/80* (2006.01)

(52) U.S. Cl.
CPC . *E06B 9/80* (2013.01); *E06B 9/72* (2013.01)

(58) Field of Classification Search
CPC ..... E06B 2009/905; E06B 9/84; E06B 9/90; E06B 9/80; E06B 9/72; E06B 9/50;
(Continued)

(56) References Cited

U.S. PATENT DOCUMENTS 8,469,171 B2 * 6/2013 Lagarde ..... F16D 67/00 192/223.4
2010/0320855 A1 * 12/2010 Lagarde ..... F16D 49/04 310/77

(Continued)

FOREIGN PATENT DOCUMENTS

CN 101839111 A 9/2010
CN 102191908 A 9/2011

(Continued)

OTHER PUBLICATIONS

International Search Report, PCT/EP2018/081637, dated Feb. 12, 2019.

*Primary Examiner* — Daniel P Cahn
(74) *Attorney, Agent, or Firm* — Nixon & Vanderhye

(57) ABSTRACT

An electromechanical actuator includes a spring brake with a helical spring, a drum, an input member, an output member and a cap. The drum includes a housing with an inner friction surface configured to cooperate with at least one turn of the spring. The input member includes a driving tooth extending between the input member and the cap. The input member or the cap includes a spacer extending between the input member and the cap. The input member includes a first radial retention element of the spring extending between the tooth and the spacer, along a first side of the brake. Furthermore, the cap includes a second radial retention element of the spring extending between the tooth and the spacer, along a second side of the brake.

20 Claims, 7 Drawing Sheets

(58) Field of Classification Search
CPC ..... E06B 2009/6845; E06B 2009/725; E06B 2009/6872; E06B 9/40; E06B 9/68; E06B 9/171; E06B 9/44; B21F 11/005; B21F 3/02; B21F 35/00; F16F 1/04; G01B 11/08; G01B 11/24; H02K 11/33; H02K 7/116; H02K 2207/03; H01R 13/625
See application file for complete search history.

(56) References Cited

U.S. PATENT DOCUMENTS

| | | | | |
|---|---|---|---|---|
| 2012/0267060 | A1* | 10/2012 | Anderson | E06B 9/262 160/241 |
| 2015/0059992 | A1* | 3/2015 | Liu | E06B 9/56 160/313 |
| 2016/0369558 | A1* | 12/2016 | Kirby | E06B 9/50 |
| 2020/0180009 | A1* | 6/2020 | Lagarde | F16F 1/04 |

FOREIGN PATENT DOCUMENTS

| | | | |
|---|---|---|---|
| CN | 104662249 | A | 5/2015 |
| CN | 105178836 | A | 12/2015 |
| CN | 205532187 | U | 8/2016 |
| FR | 2 995 001 | | 3/2014 |

* cited by examiner

ELECTROMECHANICAL ACTUATOR AND HOME AUTOMATION INSTALLATION COMPRISING SUCH AN ACTUATOR

BACKGROUND OF THE INVENTION

Field of the Invention

The present invention relates to an electromechanical actuator. The electromechanical actuator comprises a spring brake. This type of spring brake is more particularly suitable for a so-called tubular electromechanical actuator.

The present invention also relates to a home automation installation for closing or sun protection comprising a screen able to be wound on a winding tube rotated by one such electromechanical actuator.

In general, the present invention relates to the field of concealing devices comprising a motorized driving device setting a screen in motion, between at least one first position and at least one second position.

Description of the Related Art

A motorized driving device comprises an electromechanical actuator for a movable element for closing, concealing or sun protection such as a shutter, door, gate, blind or any other equivalent material, hereinafter referred to as a screen.

Document FR 2,995,001 A1 is already known, which describes an electromechanical actuator for a closure or sun protection home automation installation. The electromechanical actuator comprises an electric motor, a reduction gear and a spring brake. The spring brake comprises a helical spring, a drum, an input member, an output member and a cap. Each end of the helical spring forms a tab extending radially relative to an axis of rotation of the spring brake. The drum comprises a cylindrical housing. Furthermore, an inner friction surface of the housing of the drum is configured to cooperate with at least one turn of the helical spring. In this way, at least one turn of the helical spring is radially stressed by the housing of the drum.

The input member comprises a driving tooth. The driving tooth extends between the input member and the cap, in an assembled configuration of the spring brake. Furthermore, the input member or the cap comprises a spacer. The spacer extends between the input member and the cap, in the assembled configuration of the spring brake.

The output member comprises two lugs.

The input member is rotated by the electric motor. The driving tooth of the input member is configured to cooperate with one of the tabs of the helical spring, so as to rotate the helical spring around the axis of rotation of the spring brake in a first direction of rotation. Such a movement releases the spring brake. The frictional force between the turns of the helical spring and the inner surface of the housing of the drum is decreased during rotational driving of the helical spring in the first direction of rotation. In other words, this movement tends to decrease the diameter of the outer enclosure of the helical spring and therefore to decrease the radial stress between the helical spring and the inner surface of the housing of the drum.

One of the lugs of the output member is configured to cooperate with one of the tabs of the helical spring, so as to rotate the helical spring around the axis of rotation of the spring brake in a second direction of rotation, the second direction of rotation being opposite the first direction of rotation. Such a movement activates the spring brake. The frictional force between the turns of the helical spring and the inner surface of the housing of the drum is increased during the rotational driving of the helical spring in the second direction of rotation. In other words, this movement tends to increase the diameter of the outer enclosure of the helical spring and therefore to increase the radial stress between the helical spring and the inner surface of the housing of the drum.

However, this electromechanical actuator has the drawback of generating operating noises and manufacturing defects related to a misalignment of the helical spring relative to the input member, the output member and the cap. This misalignment generates unwanted friction between the elements of the spring brake.

As a result, in order to limit the unwanted friction, sizing adaptations of the elements of the spring brake are necessary, in particular to reduce the dimensions of the driving tooth of the input member, the spacer and the lugs of the output member, which may cause risks in terms of the quality of the spring brake and therefore the electromechanical actuator.

Furthermore, during the manufacturing of this electromechanical actuator, the helical spring lacks radial retention relative to the input member, the output member and the cap.

As a result, during assembling of the assembly formed by the input member, the helical spring, the output member and the cap inside the drum and, more particularly, during a winding operation of the helical spring, the helical spring is positioned on a slant inside the housing of the drum.

Furthermore, during assembling of the assembly formed by the input member, the helical spring, the output member and the cap inside the housing of the drum, the helical spring rubs on the inner friction surface of the housing of the drum and at least partially withdraws a lubricant deposited on this inner friction surface and on the helical spring.

SUMMARY OF THE INVENTION

The present invention aims to resolve the aforementioned drawbacks and to propose an electromechanical actuator for a closure or sun protection home automation installation comprising a spring brake, as well as a home automation installation for closing or sun protection comprising such an electromechanical actuator, making it possible to guarantee the radial retention of a helical spring with respect to an input member, an output member and a cap, during the manufacturing of the spring brake and during the operation of the spring brake, as well as to reduce the operating noises of the spring brake, during the rotational driving of an input member and/or an output member inside a housing of a drum.

To that end, according to a first aspect, the present invention relates to an electromechanical actuator for a closure or sun protection home automation installation, the electromechanical actuator comprising at least:

an electric motor, a reduction gear, and a spring brake, the spring brake comprising at least:

a helical spring, a drum, the drum comprising a housing, the housing of the drum comprising an inner friction surface configured to cooperate with at least one turn of the helical spring, an input member, an output member, and a cap, the input member comprising a driving tooth, the driving tooth extending between the input member and the cap, in an assembled configuration of the spring brake, and the input member or the cap comprising a spacer, the spacer extending between the input member and the cap, in the assembled configuration of the spring brake.

According to the invention, the input member comprises a first element for radial retention of the helical spring extending between the driving tooth and the spacer, along a first side of the spring brake, in the assembled configuration of the spring brake. Furthermore, the cap comprises a second radial retention element of the helical spring extending between the driving tooth and the spacer, along a second side of the spring brake, in the assembled configuration of the spring brake, the second side of the spring brake being opposite the first side of the spring brake, relative to an axis of rotation of the spring brake.

Thus, the first and second radial retention elements of the input member and the cap respectively extending between the driving tooth and the spacer make it possible to guarantee the radial retention of the helical spring with respect to the input member, the output member and the cap, during the manufacturing of the spring brake and during the operation of the spring brake, as well as to reduce the operating noises of the spring brake, during the rotational driving of the input member and/or the output member inside the housing of the drum.

In this way, the first and second radial retention elements of the input member and the cap respectively extending between the driving tooth and the spacer make it possible to avoid manufacturing defects related to a misalignment of the helical spring with respect to the input member, the output member and the cap.

As a result, the first and second radial retention elements of the input member and the cap respectively extending between the driving tooth and the spacer make it possible to guarantee the positioning of the helical spring inside the housing of the drum, during the assembly of the spring brake and, more specifically, during a winding operation of the helical spring.

Furthermore, during the assembly of the spring brake, the first and second radial retention elements of the input member and the cap respectively extending between the driving tooth and the spacer make it possible to limit rubbing of the helical spring on the inner friction surface of the housing of the drum and therefore to avoid the withdrawal of at least part of a lubricant deposited on this inner friction surface and on the helical spring.

According to one advantageous feature of the invention, the first and second radial retention elements respectively comprise a rib extending partially between the input member and the cap, along the direction of the rotation axis, in the assembled configuration of the spring brake.

According to another advantageous feature of the invention, an outer surface of the first radial retention element and an outer surface of the second radial retention element are configured to cooperate with at least one turn of the helical spring.

According to another advantageous feature of the invention, the helical spring is formed from a wire. A first end of the helical spring forms a first tab. A second end of the helical spring forms a second tab. Furthermore, each of the first and second tabs extends radially relative to the rotation axis and toward the inside of the helical spring.

According to another advantageous feature of the invention, in the assembled configuration of the spring brake, the first tab of the helical spring is configured to cooperate with a first surface of the driving tooth of the input member and the second tab of the helical spring is configured to cooperate with a second surface of the driving tooth of the input member, the second surface of the driving tooth being opposite the first surface of the driving tooth.

According to another advantageous feature of the invention, in the assembled configuration of the spring brake, the first tab of the helical spring is positioned between the first surface of the driving tooth of the input member and the spacer. Furthermore, the second tab of the helical spring is positioned between the second surface of the driving tooth of the input member and the spacer.

According to another advantageous feature of the invention, the input member comprises a first plate. The cap comprises a second plate. Furthermore, in the assembled configuration of the spring brake, the first tab of the helical spring extends along the second plate of the cap and the second tab of the helical spring extends along the first plate of the input member.

According to another advantageous feature of the invention, the input member and the cap are kept secured in rotation about the axis of rotation, in the assembled configuration of the spring brake.

According to another advantageous feature of the invention, the input member and the cap are fastened to one another using fastening elements. Furthermore, the fastening elements of the input member and the cap are fastening elements by resilient snapping positioned at the driving tooth and the spacer.

According to a second aspect, the invention relates to a home automation installation for closing or providing sun protection that comprises a screen able to be wound on a winding tube rotated by an electromechanical actuator according to the invention.

This home automation installation has features and advantages similar to those previously described relative to the electromechanical actuator according to the invention, as described above.

Other particularities and advantages of the invention will also appear in the description below.

BRIEF DESCRIPTION OF THE DRAWINGS

In the appended drawings, provided as non-limiting examples.

DESCRIPTION OF THE PREFERRED EMBODIMENTS

Figure 1:
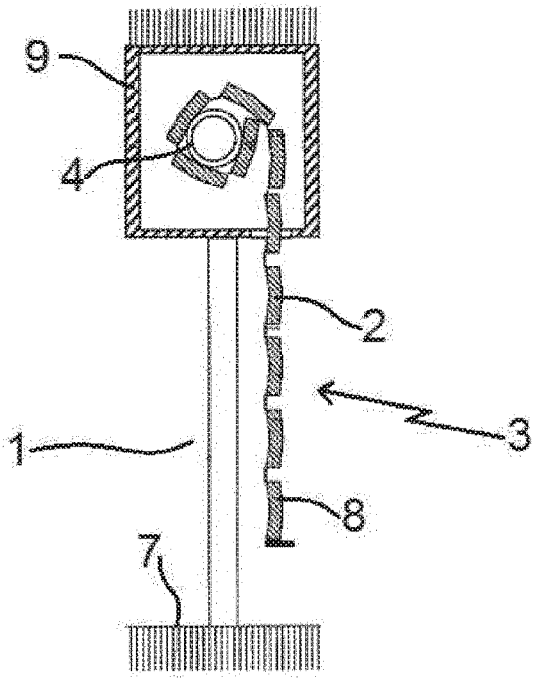
FIG. 1 is a cross-sectional schematic view of a home automation installation according to one embodiment of the invention.
Figure 2:
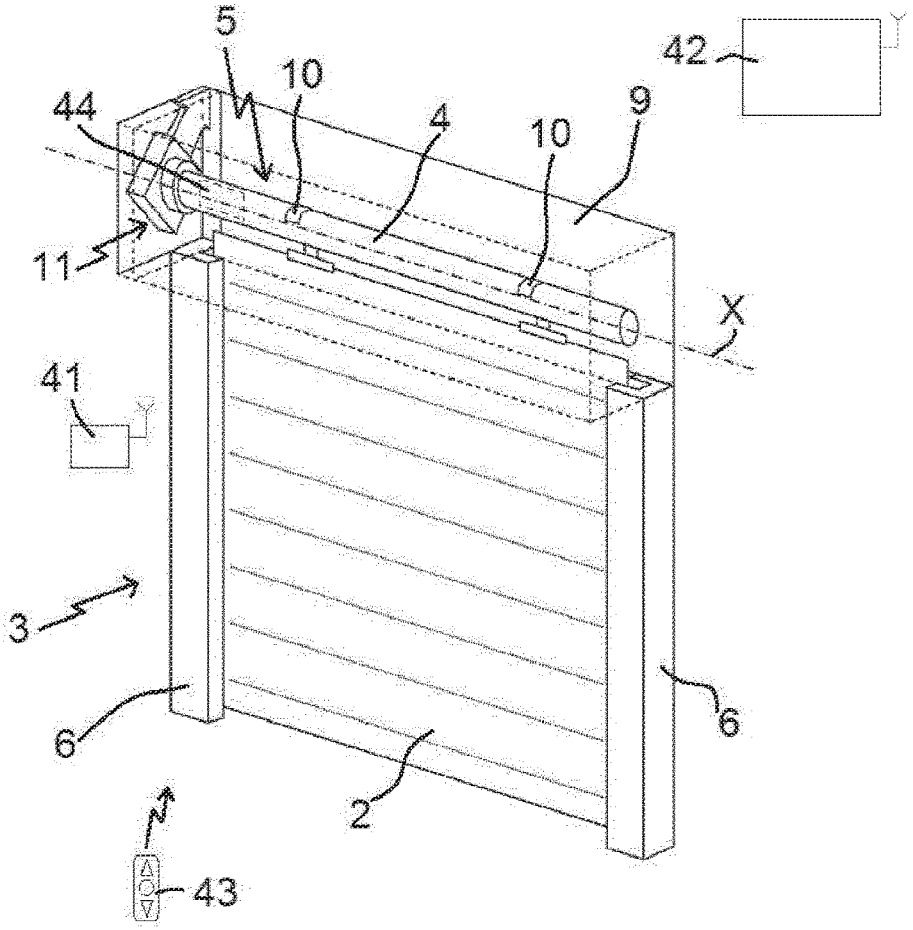
FIG. 2 is a perspective schematic view of the home automation installation illustrated in FIG. 1.

In reference to FIGS. 1 and 2, we first describe a home automation installation according to the invention and installed in a building comprising an opening 1, window or door, equipped with a screen 2 belonging to a concealing device 3, in particular a motorized rolling shutter.

The concealing device 3 can be a rolling shutter, as illustrated in FIGS. 1 and 2, a canvas blind or a blind with adjustable slats, or a rolling gate. The present invention applies to all types of concealing devices.

A rolling shutter according to one embodiment of the invention is described in reference to FIGS. 1 and 2.

The screen 2 of the concealing device 3 is wound on a winding tube 4 driven by a motorized driving device 5 and movable between a wound position, in particular an upper position, and an unwound position, in particular a lower position.

The moving screen 2 of the concealing device 3 is a closing, concealing and/or sun protection screen, winding on the winding tube 4, the inner diameter of which is generally substantially greater than the outer diameter of an electromechanical actuator 11, such that the electromechanical actuator 11 can be inserted into the winding tube 4, during the assembly of the concealing device 3.

The motorized driving device 5 comprises the electromechanical actuator 11, in particular of the tubular type, making it possible to set the winding tube 4 in rotation, so as to unwind or wind the screen 2 of the concealing device 3.

The concealing device 3 comprises the winding tube 4 for winding the screen 2. In the mounted state, the electromechanical actuator 11 is inserted into the winding tube 4.

In a known manner, the rolling shutter, which forms the concealing device 3, comprises an apron comprising horizontal slats articulated on one another, forming the screen 2 of the rolling shutter 3, and guided by two lateral guideways 6. These slats are joined, when the apron 2 of the rolling shutter 3 reaches its unwound lower position.

In the case of a rolling shutter, the wound upper position corresponds to the bearing of a final end slat 8, which is for example L-shaped, of the apron 2 of the rolling shutter 3 against an edge of a box 9 of the rolling shutter 3 or when the final end slat 8 stops in a programmed upper end-of-travel position. Furthermore, the unwound lower position corresponds to the bearing of the final end slat 8 of the apron 2 of the rolling shutter 3 against a threshold 7 of the opening 1 or the stopping of the final end slat 8 in a programmed lower end-of-travel position.

The first slat of the apron 2 of the rolling shutter 3, opposite the final end slat 8, is connected to the winding tube 4 using at least one articulation 10, in particular a fastener in strip form.

The winding tube 4 is positioned inside the box 9 of the rolling shutter 3. The apron 2 of the rolling shutter 3 winds and unwinds around the winding tube 4 and is housed at least partially inside the box 9.

In general, the box 9 is positioned above the opening 1, or in the upper part of the opening 1.

The motorized driving device 5 is controlled by a control unit. The control unit may, for example, be a local control unit 41, where the local control unit 41 can be connected through a wired or wireless connection with a central control unit 42. The central control unit 42 can drive the local control unit 41, as well as other similar local control units distributed throughout the building.

The central control unit 42 can be in communication with a weather station located outside the building, in particular including one or more sensors that can be configured, for example, to determine a temperature, a brightness, or a wind speed.

A remote control 43, which can be a type of local control unit, provided with a control keypad and which comprises selection and display means, further allows a user to intervene on the electromechanical actuator 11, the local control unit 41 and/or the central control unit 42.

The motorized driving device 5 is, preferably, configured to carry out the unwinding or winding commands of the screen 2 of the concealing device 3, which may, in particular, be acquired by the remote control 43.

Figure 3:
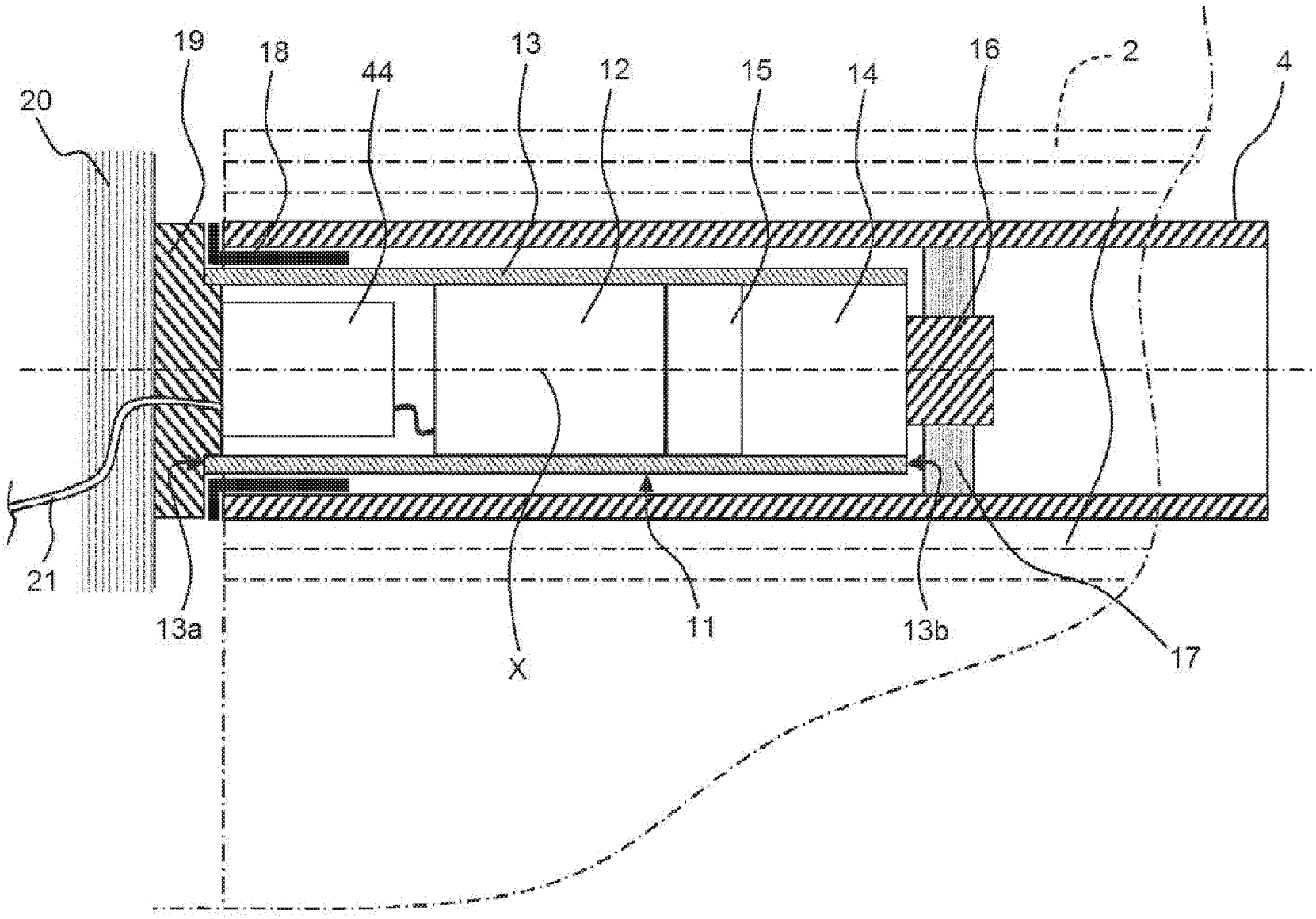
FIG. 3 is a partial sectional schematic view of the home automation installation illustrated in FIG. 2, at an electromechanical actuator.

The electromechanical actuator 11 belonging to the home automation installation of FIGS. 1 and 2 is now described in more detail and in reference to FIG. 3.

The electromechanical actuator 11 comprises at least an electric motor 12, a reduction gear 14 and a spring brake 15.

The electric motor 12 comprises a rotor and a stator, not shown, positioned coaxially around a rotation axis X, which is also the rotation axis of the winding tube 4 in the assembled configuration of the motorized driving device 5.

Control means for controlling the electromechanical actuator 11, making it possible to move the screen 2 of the concealing device 3, comprise at least an electronic control unit 44. This electronic control unit 44 is able to operate the electric motor 12 of the electromechanical actuator 11 and, in particular, to allow the supply of electricity for the electric motor 12.

Thus, the electronic control unit 44, in particular, controls the electric motor 12, so as to open or close the screen 2, as previously described.

The electronic control unit 44 also comprises an order receiving module, in particular for wireless orders sent by an order transmitter, such as the remote control 43 designed to control the electromechanical actuator 11 or one of the local 41 or central 42 control units.

The order receiving module can also allow the reception of orders sent by wired means.

Here, and as illustrated in FIG. 3, the electronic control unit 44 is positioned inside a casing 13 of the electromechanical actuator 11.

The control means of the electromechanical actuator 11 comprise hardware and/or software means.

As a non-limiting example, the hardware means may comprise at least one microcontroller.

The electromechanical actuator 11 is supplied with electricity by an electricity grid of the sector, or using a battery, which can, for example, be recharged by a photovoltaic panel. The electromechanical actuator 11 makes it possible to move the screen 2 of the concealing device 3.

Here, the electromechanical actuator 11 comprises an electrical power cable 21 allowing it to be supplied with electricity from an electricity grid of the sector.

The casing 13 of the electromechanical actuator 11 is, preferably, in cylindrical shape.

In one embodiment, the casing 13 is made from a metal material.

The material of the casing of the electromechanical actuator is in no way limiting and may be different. In particular, it can be a plastic material.

The winding tube 4 is rotated around the rotation axis X and the casing 13 of the electromechanical actuator 11 supported by two pivot links. The first pivot link is produced at a first end of the winding tube 4 using a crown 18 inserted around and at an end 13*a* of the casing 13 of the electromechanical actuator 11. The crown 18 thus makes it possible to produce a bearing. The second pivot link, not shown in FIG. 3, is produced at a second end of the winding tube 4.

The electromechanical actuator 11 comprises a torque support 19. The torque support 19 protrudes at one end 13*a* of the casing 13 of the electromechanical actuator 11, in particular the end 13*a* of the casing 13 receiving the crown 18. The torque support 19 of the electromechanical actuator 11 thus makes it possible to fasten the electromechanical actuator 11 on a housing 20, in particular a flange of the box 9.

Furthermore, the torque support 19 of the electromechanical actuator 11 can make it possible to close off the end 13*a* of the casing 13.

Furthermore, the torque support 19 of the electromechanical actuator 11 can make it possible to support the electronic control unit 44. The electronic control unit 44 can be supplied with electricity via the electrical power cable 21 electrically connected to the electricity grid of the sector, or a battery.

The reduction gear 14 comprises at least one reduction stage. Said at least one reduction stage can be a gear train of the epicyclic type.

The type and number of reduction stages of the reduction gear are in no way limiting.

The electromechanical actuator 11 comprises an output shaft 16. An end of the output shaft 16 protrudes relative to the casing 13 of the electromechanical actuator 11, in particular relative to an end 13*b* of the casing 13 opposite its end 13*a*.

The output shaft 16 of the electromechanical actuator 11 is configured to rotate a connecting element 17 connected to the winding tube 4. The connecting element 17 is made in the form of a wheel.

When the electromechanical actuator 11 is operated, the electric motor 12 and the reduction gear 14 rotate the output shaft 16. Furthermore, the output shaft 16 of the electromechanical actuator 11 rotates the winding tube 4 via the connecting element 17. Thus, the winding tube 4 rotates the screen 2 of the concealing device 3, so as to open or close the opening 1.

The electric motor 12, the reduction gear 14 and the spring brake 15 are mounted inside the casing 13 of the electromechanical actuator 11.

In the embodiment illustrated in FIG. 3, the spring brake 15 is positioned between the electric motor 12 and the reduction gear 14, that is to say at the output of the electric motor 12.

In another embodiment, not shown, where the reduction gear 14 comprises a plurality of reduction stages, the spring brake 15 is positioned between two reduction stages of the reduction gear 14.

In another embodiment, not shown, the spring brake 15 is positioned at the output of the reduction gear 14.

The electromechanical actuator 11 may also comprise an end-of-travel and/or obstacle detection device, this detection device being able to be mechanical or electronic.

The spring brake 15 of the electromechanical actuator 11, illustrated in FIG. 3 and according to one embodiment of the invention, is now described in reference to FIGS. 4 to 9.

The spring brake 15 comprises at least one helical spring 22, a drum 23, an input member 24, an output member 25 and a cap 33.

Advantageously, the drum 23 is kept in position in the casing 13 of the electromechanical actuator 11, in particular using clearances 28 arranged on the outer periphery of the drum 23 and configured to cooperate with tongues, not shown, of an enclosure of the reduction gear 14.

Furthermore, the enclosure of the reduction gear 14 is kept in position in the casing 13 of the electromechanical actuator 11.

The drum 23 comprises a housing 26.

Here, the housing 26 of the drum 23 is in cylindrical shape. Furthermore, the housing 26 of the drum 23 is a through housing.

Advantageously, the helical spring 22, the input member 24, the output member 25 and the cap 33 are positioned inside the housing 26 of the drum 23, in an assembled configuration of the spring brake 15.

Here, the output member 25 is positioned opposite the input member 24.

Advantageously, the helical spring 22 comprises a plurality of turns. The turns of the helical spring 22 are centered on an axis combined with the rotation axis X, when the spring brake 15 is assembled, then mounted in the electromechanical actuator 11.

Likewise, the input member 24 and the output member 25 are centered on an axis combined with the axis of rotation X, when the spring brake 15 is assembled, then mounted in the electromechanical actuator 11.

The axis of each of the members 22, 23, 24, 25, 33 of the spring brake 15 is not shown in FIGS. 4 to 9, so as to simplify the reading thereof.

The housing 26 of the drum 23 comprises an inner friction surface 27 configured to cooperate with at least one turn of the helical spring 22.

Thus, at least one turn of the helical spring 22 is radially stressed by the housing 26 of the drum 23.

Figure 7:
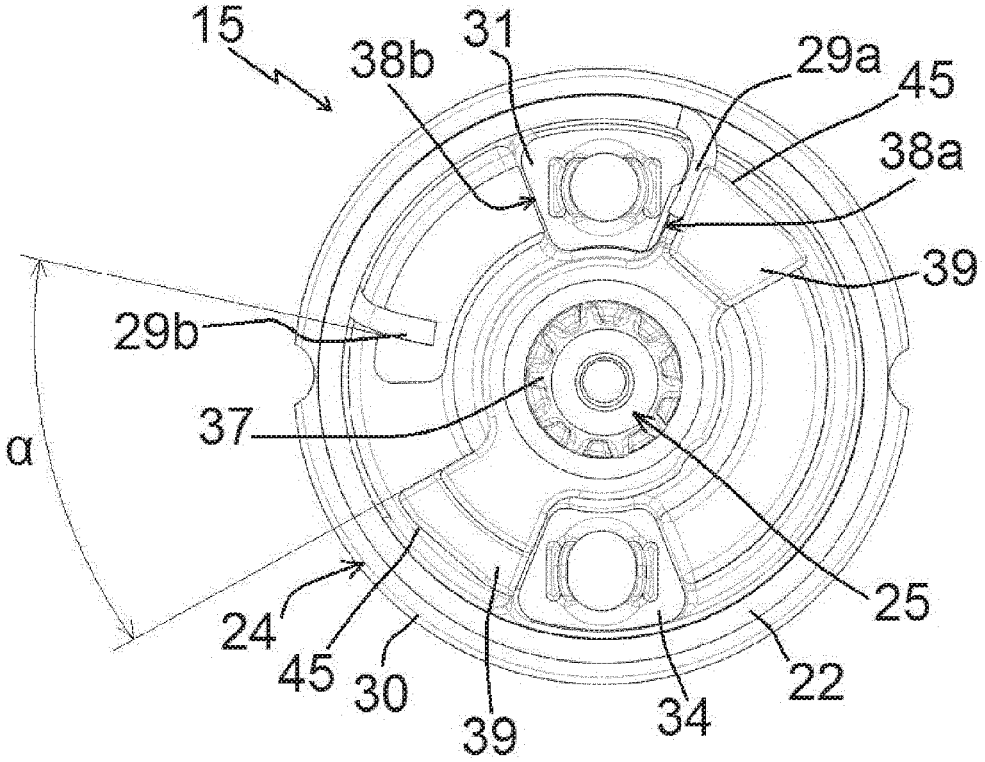
FIG. 7 is a second sectional schematic view of the spring brake illustrated in FIGS. 4 to 6, after the introduction of the input member, the output member and the helical spring inside the drum, where the drum of the spring brake has been removed.

Here, the helical spring 22 is mounted tightly inside the housing 26 of the drum 23, so as to secure the helical spring 22 and the drum 23 by friction, when the helical spring 22 is idle, as illustrated in FIG. 7.

Advantageously, the helical spring 22 is formed from a wire 48. A first end of the helical spring 22 forms a first tab 29*a*. A second end of the helical spring 22 forms a second tab 29*b*. Furthermore, each of the first and second tabs 29*a*, 29*b* extends radially relative to the rotation axis X and toward the inside of the helical spring 22.

Figure 4:
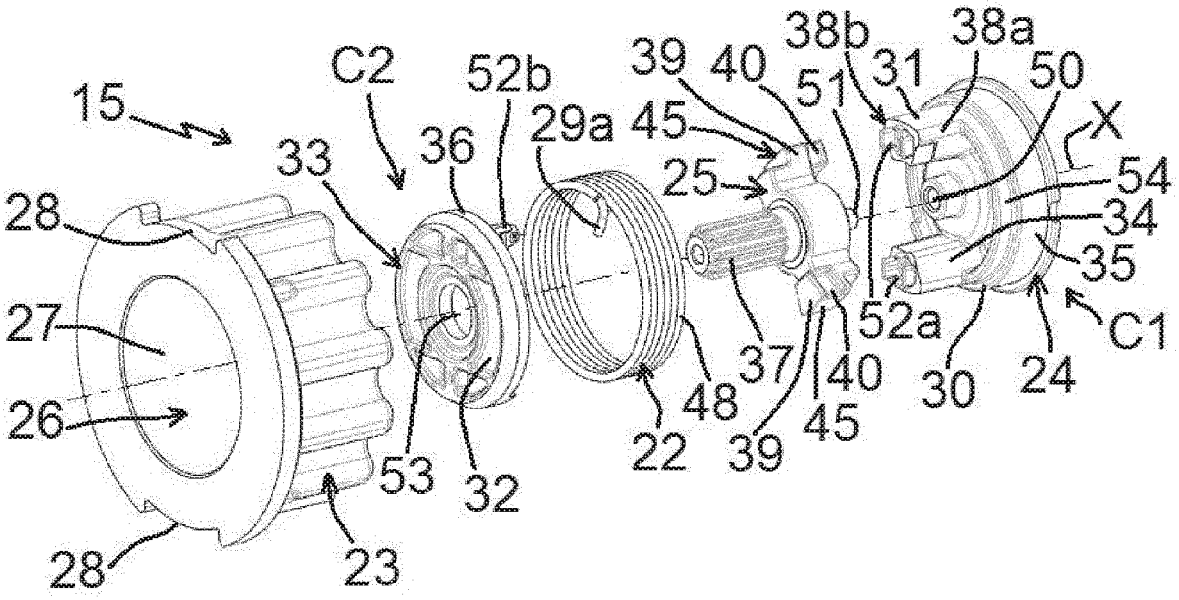
FIG. 4 is an exploded and perspective schematic view of a spring brake of the electromechanical actuator illustrated in FIG. 3.

Thus, the helical spring 22 includes two tabs 29*a*, 29*b*, only one of which is visible in FIG. 4.

Here, each tab 29*a*, 29*b* of the helical spring 22 extends radially relative to the axis of rotation X, in the assembled configuration of the spring brake 15.

In a variant, not shown, each tab 29*a*, 29*b* of the helical spring 22 extends axially relative to the axis of rotation X, in the assembled configuration of the spring brake 15.

In this exemplary embodiment, the tabs 29*a*, 29*b* of the helical spring 22 extend radially relative to the rotation axis X and toward the inside of the helical spring 22, in particular from the turns of the helical spring 22 toward the central axis of the helical spring 22, as illustrated in FIG. 4.

The input member 24, in particular a driving tooth 31, is configured to cooperate with at least one of the tabs 29*a*, 29*b* of the helical spring 22, so as to rotate the helical spring 22 around the rotation axis X in a first direction of rotation.

Such a movement releases the spring brake 15.

The friction force between at least one turn of the helical spring 22 and the inner surface 27 of the housing 26 of the drum 23 is decreased during the rotational driving of the helical spring 22 in the first direction of rotation.

In other words, this movement tends to decrease the diameter of the outer enclosure of the helical spring 22 and therefore to decrease the radial stress between the helical spring 22 and the inner surface 27 of the housing 26 of the drum 23.

Thus, the movement generated by the electric motor 12 can be transmitted from the input member 24 to the output member 25.

The outer enclosure of the helical spring 22 is defined by the outer generatrixes of the turns of the helical spring 22.

Figure 6:
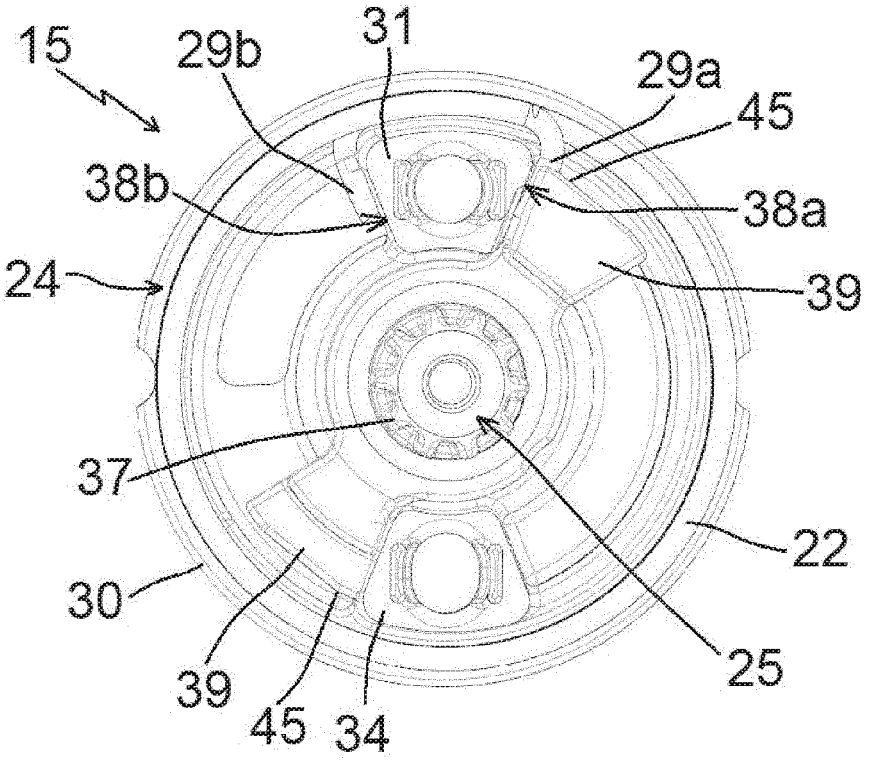
FIG. 6 is a first sectional schematic view of the spring brake illustrated in FIGS. 4 and 5, before the introduction of an input member, an output member and a helical spring inside the drum.

Advantageously, the output member 25 comprises two lugs 39, as illustrated in FIGS. 4, 6 and 7. The lugs 39 of the output member 25 are configured to be inserted inside the helical spring 22, in the assembled configuration of the spring brake 15.

Preferably, each lug 39 of the output member 25 comprise a recess 40. The recess 40 of each lug 39 of the output member 25 is configured to cooperate with one of the tabs 29*a*, 29*b* of the helical spring 22.

The output member 25, in particular one of the lugs 39, is configured to cooperate with at least one of the tabs 29*a*, 29*b* of the helical spring 22 so as to rotate the helical spring 22 around the rotation axis X in a second direction of rotation. The second direction of rotation is opposite the first direction of rotation.

Such a movement activates the spring brake 15, that is to say tends to block or slow the rotation of the helical spring 22 inside the housing 26 of the rotating drum 23.

The friction force between at least one turn of the helical spring 22 and the inner surface 27 of the housing 26 of the drum 23 is increased during the rotational driving of the helical spring 22 in the second direction of rotation.

In other words, this movement tends to increase the diameter of the outer enclosure of the helical spring 22, in particular by bringing the tabs 29*a*, 29*b* of the helical spring 22 closer together, and therefore to increase the radial stress between the helical spring 22 and the inner surface 27 of the housing 26 of the drum 23.

Advantageously, the spring brake 15 comprises a lubricant, not shown, arranged between the helical spring 22 and the inner surface 27 of the housing 26 of the drum 23. The lubricant is, preferably, grease.

Advantageously, the input member 24 is configured to be rotated by the electric motor 12, in an assembled configuration of the electromechanical actuator 11.

Figure 8:
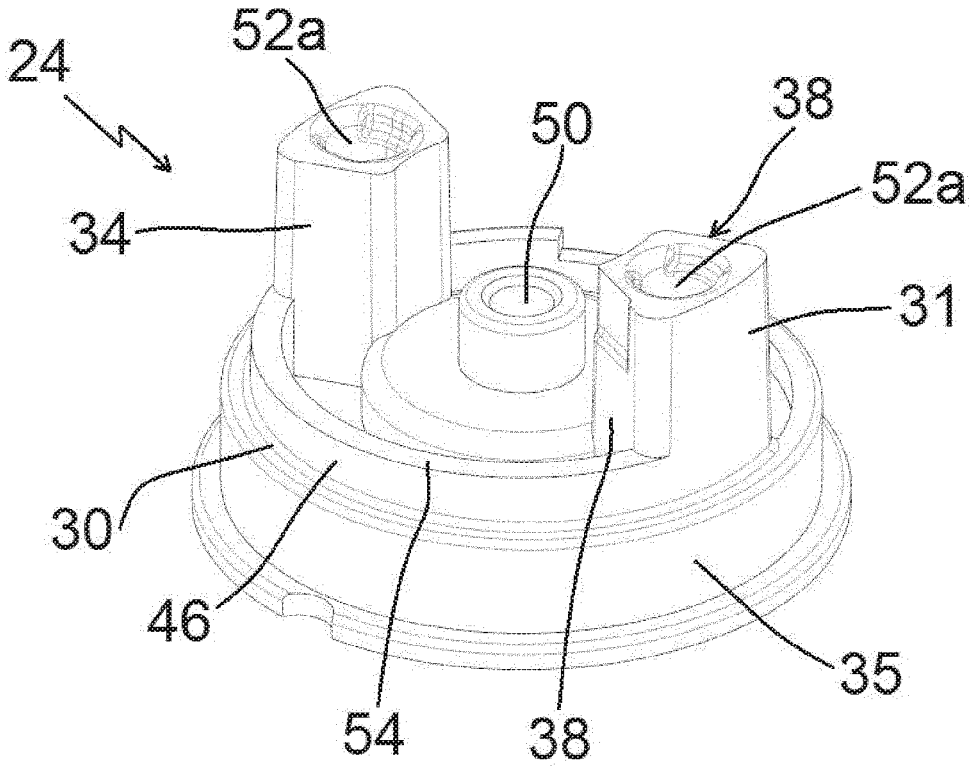
FIG. 8 is a perspective schematic view of the input member of the spring brake illustrated in FIGS. 4 to 7.

Here, and as illustrated in FIGS. 4 and 8, the input member 24 comprises a housing 50. The housing 50 of the input member 24 is configured to cooperate with a shaft 37 of the output member 25.

Thus, the shaft 37 of the output member 25 makes it possible to receive and transmit torque coming from the electric motor 12.

In this exemplary embodiment, the shaft 37 of the output member 25 is configured to cooperate with the reduction gear 14.

Thus, the shaft 37 of the output member 25 makes it possible to receive and transmit torque coming from the electric motor 12 to the reduction gear 14, by means of the housing 50 of the input member 24 and the shaft 37 of the output member 25.

The shaft 37 of the output member 25 is centered relative to the rotation axis X, in the assembled configuration of the electromechanical actuator 11.

In this exemplary embodiment, the housing 50 of the input member 24 is made using a bore, positioned at the center of the input member 24 and, more specifically, centered relative to the rotation axis X, in the assembled configuration of the spring brake 15. Furthermore, the output member 25 comprises a slug 51, positioned in the alignment of the shaft 37. The slug 51 of the output member 25 is therefore also centered relative to the rotation axis X, in the assembled configuration of the spring brake 15.

Thus, the slug 51 of the output member 25 is inserted into the housing 50 of the input member 24.

In this way, the output member 25 is centered relative to the input member 24, using the housing 50 of the input member 24 and the slug 51 of the output member 25.

Advantageously, the cap 33 comprises an opening 53. Furthermore, the opening 53 of the cap 33 is a through opening. The opening 53 of the cap 33 is configured to cooperate with the shaft 37 of the output member 25.

Thus, the shaft 37 of the output member 25 is inserted into the opening 53 of the cap 33, so as to extend on either side of the cap 33, in the assembled configuration of the spring brake 15.

The input member 24 comprises the driving tooth 31, as illustrated in FIGS. 4 and 6 to 8. The driving tooth 31 extends between the input member 24 and the cap 33, in the assembled configuration of the spring brake 15.

Advantageously, the driving tooth 31 of the input member 24 is inserted inside the helical spring 22, in the assembled configuration of the spring brake 15.

Preferably, the input member 24 comprises a first plate 30. Furthermore, the cap 33 comprises a second plate 32.

Advantageously, in the assembled configuration of the spring brake 15, the first tab 29*a* of the helical spring 22 extends along the second plate 32 of the cap 33 and the second tab 29*b* of the helical spring 22 extends along the first plate 30 of the input member 24.

Here, the first plate 30 comprises the driving tooth 31.

Advantageously, in the assembled configuration of the spring brake 15, the first tab 29*a* of the helical spring 22 is configured to cooperate with a first surface 38*a* of the driving tooth 31 of the input member 24 and the second tab 29*b* of the helical spring 22 is configured to cooperate with a second surface 38*b* of the driving tooth 31 of the input member 24. The second surface 38*b* of the driving tooth 31 is opposite the first surface 38*a* of the driving tooth 31.

Thus, the driving tooth 31 of the input member 24 is positioned between the two tabs 29*a*, 29*b* of the helical spring 22 and is configured to cooperate with one or the other of the tabs 29*a*, 29*b* of the helical spring 22, depending on the direction of rotation generated by the electric motor 12, as illustrated in FIGS. 6 and 7.

In this way, the driving tooth 31 of the input member 24 comprises two driving faces 38*a*, 38*b*. Each driving face 38*a*, 38*b* of the driving tooth 31 is configured to cooperate with one of the tabs 29*a*, 29*b* of the helical spring 22.

Figure 5:
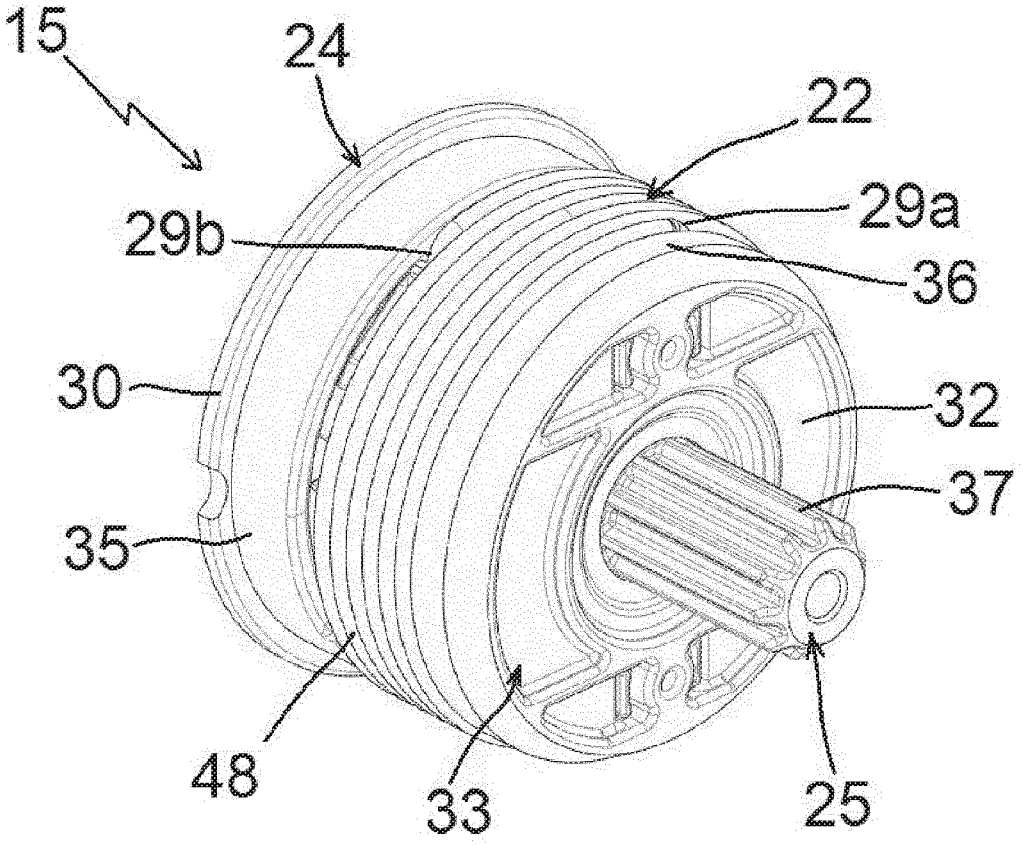
FIG. 5 is a perspective schematic view of the spring brake illustrated in FIG. 4, where a drum of the spring the brake has been removed.

Here, and as illustrated in FIGS. 4 and 5, the helical spring 22 and the output member 25 are kept axially in position between the first plate 30 of the input member 24 and the second plate 32 of the cap 33.

The input member 24 and, more specifically, the first plate 30 comprises a spacer 34. The spacer 34 extends between the input member 24 and the cap 33, in the assembled configuration of the spring brake 15.

Thus, the spacer 34 of the input member 24 makes it possible to maintain an axial separation between the input member 24 and the cap 33 and, more specifically, between the first and second plates 30, 32.

Here, the spacer 34 of the input member 24 is positioned diametrically opposite the driving tooth 31 of the input member 24, as illustrated in FIGS. 4 and 6 to 8.

Furthermore, in this exemplary embodiment, the driving tooth 31 of the input member 24 corresponds to another spacer.

Thus, the driving tooth 31 of the input member 24 also makes it possible to maintain the axial separation between the input member 24 and the cap 33 and, more specifically, between the first and second plates 30, 32.

Figure 10:
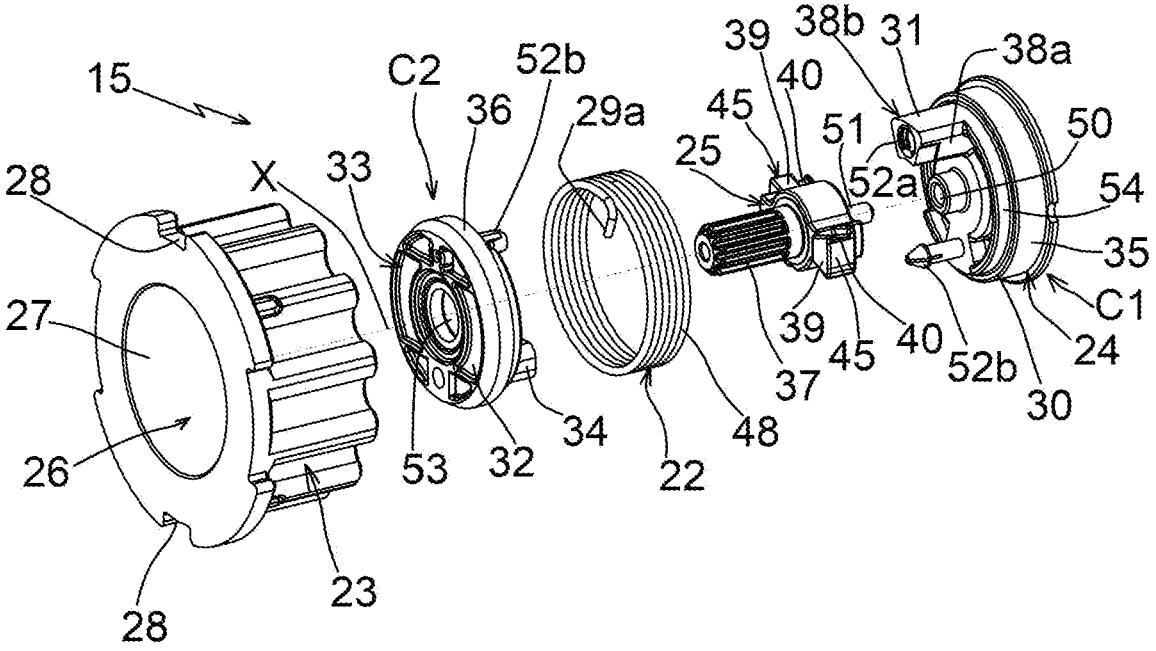
FIGS. 10 and 11 show a particular embodiment where the cap comprises a spacer.
Figure 11:
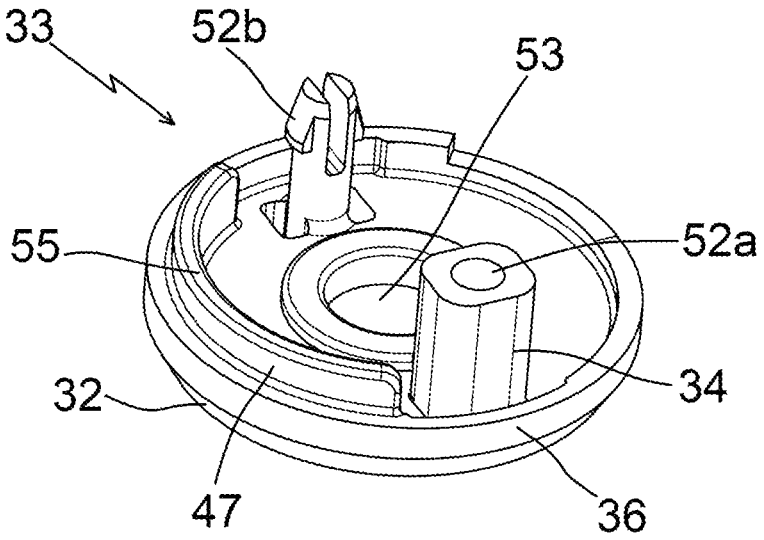

In a variant shown in FIGS. 10 and 11, the cap 33 and, more specifically, the second plate 32 comprises the spacer 34. The spacer 34 extends between the input member 24 and the cap 33, in the assembled configuration of the spring brake 15.

In such a case, the spacer 34 of the cap 33 can be positioned diametrically opposite the driving tooth 31 of the input member 24, relative to the rotation axis X, in the assembled configuration of the spring brake 15.

Here and as illustrated in FIGS. 4, 5, 8 and 9, the first and second plates 30, 32 each comprise a peripheral flange ring 35, 36. The two peripheral flange rings 35, 36 are positioned opposite one another along the rotation axis X, in the assembled configuration of the spring brake 15.

The input member 24 comprises a first radial retention element 54 of the helical spring 22 extending between the driving tooth 31 and the spacer 34, along a first side C1 of the spring brake 15, in the assembled configuration of the spring brake 15.

Furthermore, the cap 33 comprises a second radial retention element 55 of the helical spring 22 extending between the driving tooth 31 and the spacer 34, along a second side C2 of the spring brake 15, in the assembled configuration of the spring brake 15.

Figure 9:
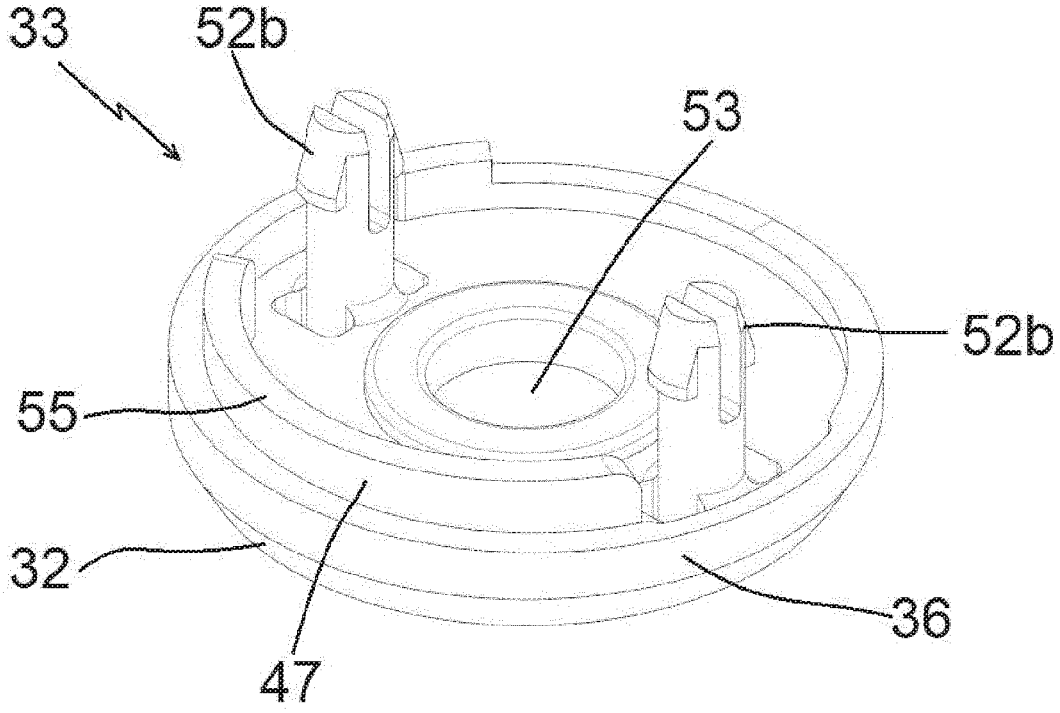
FIG. 9 is a perspective schematic view of a cap of the spring brake illustrated in FIGS. 4 to 7.

Here, the second radial retention element 55 of the cap 33 is visible in FIG. 9.

The second side C2 of the spring brake 15 is opposite, more specifically diametrically opposite, the first side C1 of the spring brake 15, relative to the rotation axis X.

Thus, the first and second radial retention elements 54, 55 of the input member 24 and the cap 33 respectively extending between the driving tooth 31 and the spacer 34 make it possible to guarantee the radial retention of the helical spring 22 with respect to the input member 24, the output member 25 and the cap 33, during the manufacturing of the spring brake 15 and during the operation of the spring brake 15, as well as to reduce the operating noises of the spring brake 15, during the rotational driving of the input member 24 and/or the output member 25 inside the housing 26 of the drum 23.

In this way, the first and second radial retention elements 54, 55 of the input member 24 and the cap 33 respectively extending between the driving tooth 31 and the spacer 34 make it possible to avoid manufacturing defects related to a misalignment of the helical spring 22 with respect to the input member 24, the output member 25 and the cap 33.

As a result, the first and second radial retention elements 54, 55 of the input member 24 and the cap 33 respectively extending between the driving tooth 31 and the spacer 34 make it possible to guarantee the positioning of the helical spring 22 inside the housing 26 of the drum 23, during the assembly of the spring brake 15 and, more specifically, during a winding operation of the helical spring 22.

Here, the first and second radial retention elements 54, 55 of the input member 24 and the cap 33 are respectively positioned on one side C1, C2 of the spring brake 15 relative to the rotation axis X and, more specifically, positioned diametrically opposite relative to the rotation axis X.

Furthermore, during the assembly of the spring brake 15, the first and second radial retention elements 54, 55 of the input member 24 and the cap 33 respectively extending between the driving tooth 31 and the spacer 34 make it possible to limit rubbing of the helical spring 22 on the inner friction surface 27 of the housing 26 of the drum 23 and therefore to avoid the withdrawal of at least part of a lubricant deposited on this inner friction surface 27 and on the helical spring 22.

Furthermore, the design of such a spring brake 15 requires considering an angular travel a between one of the tabs 29*a*, 29*b* of the helical spring 22, in the present case the second tab 29*b* of the helical spring 22, and one of the lugs 39 of the output member 25, in the present case a second lug 39 of the output member 25, so as to allow the spring brake 15 to be operated, both during the release and during the activation of the spring brake 15, as illustrated in FIG. 7.

This angular travel a makes it possible to determine the angular dimensioning of the driving tooth 31 of the input member 24, the spacer 34 and the lugs 39 of the output member 25.

The first and second radial retention elements 54, 55, respectively of the input member 24 and the cap 33 make it possible to limit the value of the angular travel a and, as a result, to optimize the angular dimensioning of the driving tooth 31 of the input member 24, the spacer 34 and the lugs 39 of the output member 25, so as to guarantee the robustness thereof.

As a non-limiting example, the angular travel a can be reduced by a value in the order of 8° to 10°.

The design of such a spring brake 15 further requires taking account of the outer diameter of the output member 25, so as to limit the operating noises of the spring brake 15, related to the rubbing of at least one turn of the helical spring 22 against an outer surface 45 of the output member 25 and, more specifically, the lugs 39 of the output member 25.

The first and second radial retention elements 54, 55, respectively of the input member 24 and the cap 33 make it possible to avoid the rubbing of at least one turn of the helical spring 22 against the outer surface 45 of the output member 25 and, as a result, to optimize the outer diameter of the output member 25. The outer diameter of the output member 25 is defined by a circle passing through the outer surface 45 of each of the lugs 39 of the output member 25.

The first and second radial retention elements 54, 55, respectively of the input member 24 and the cap 33 make it possible to guarantee the radial retention of the helical spring 22 relative to the input member 24, the output member 25 and the cap 33, during the manufacturing of the spring brake 15 and during the operation of the spring brake 15.

In this way, the lubrication of the spring brake 15 and, in particular, of the contact area between the helical spring 22 and the inner surface 27 of the housing 26 of the drum 23 is improved.

Advantageously, the first side C1 and the second side C2 of the spring brake 15 are defined relative to the rotation axis X.

Here, the rotation axis X extends to the center of the spring brake 15 and, more specifically, between the driving tooth 31 and the spacer 34, in the assembled configuration of the spring brake 15.

In reference to FIG. 4, the first side C1 of the spring brake 15 is located to the right of the rotation axis X. Furthermore, the second side C2 of the spring brake 15 is located to the left of the rotation axis X.

Advantageously, the first and second radial retention elements 54, 55 respectively comprise a rib extending partially between the input member 24 and the cap 33, along the direction of the rotation axis X, in the assembled configuration of the spring brake 15.

Thus, the radial retention of the helical spring 15 relative to the input member 24, the output member 25 and the cap 33 is implemented along an axial direction of the spring brake 15 and, more specifically, along the rotation axis X, so as to guarantee the alignment of the members 22, 24, 25, 33 of the spring brake 15.

Advantageously, an outer surface 46 of the first radial retention element 54 and an outer surface 47 of the second radial retention element 55 are configured to cooperate with at least one turn of the helical spring 22.

Thus, the radial retention of the helical spring 15 with respect to the input member 24, the output member 25 and the cap 33 is implemented by the bearing of at least one turn of the helical spring 22 against an outer surface of the input member 24 and an outer surface of the cap 33.

Here, the radial retention of the helical spring 15 with respect to the input member 24, the output member 25 and the cap 33 is implemented by the bearing of at least one first turn of the helical spring 22 against an outer surface of the input member 24 and by the bearing of at least one second turn of the helical spring 22 against an outer surface of the cap 33.

Advantageously, in the assembled configuration of the spring brake 15, the first tab 29*a* of the helical spring 22 is positioned between the first surface 38*a* of the driving tooth 31 of the input member 24 and the spacer 34. Furthermore, the second tab 29*b* of the helical spring 22 is positioned between the second surface 38*b* of the driving tooth 31 of the input member 24 and the spacer 34.

Advantageously, the input member 24 and the cap 33 and, more specifically, the first and second plates 30, 32 are kept secured in rotation around the rotation axis X, in the assembled configuration of the spring brake 15.

Here, the input member 24 and the cap 33 are fastened to one another using fastening elements 52*a*, 52*b*.

Advantageously, the fastening elements 52*a*, 52*b* of the input member 24 and the cap 33 are fastening elements by resilient snapping positioned at the driving tooth 31 and the spacer 34.

In this exemplary embodiment, a first fastening element 52*a* of the input member 24 is arranged at the driving tooth 31 of the input member 24. Furthermore, a second fastening element 52*a* of the input member 24 is arranged at the spacer 34 of the input member 24.

Here, the input member 24 comprises two fastening elements 52*a* and the cap 33 comprises two fastening elements 52*b*.

In reference to FIG. 4, only one of the fastening elements 52*b* of the cap 33 is shown.

The number of fastening elements of the input member and the cap is not limiting and can be different, in particular greater than or equal to three.

In a variant, not shown, the input member 24 and the cap 33 and, more specifically, the first and second plates 30, 32, can be kept secured by simple nesting.

The output member 25 is configured to be coupled to the screen 2 of the concealing device 3.

Advantageously, the input member 24 and the output member 25 are made from plastic material.

Furthermore, the cap 33 is made from plastic material.

As a non-limiting example, the plastic material of the input member 24, the output member 25 and the cap 33 can be polybutylene terephthalate, also called PBT, or polyacetal, also called POM.

In a variant, the output member 25 can be made from zamac (acronym for the names of its component metals: zinc, aluminum, magnesium and copper).

Preferably, the drum 23 is made from steel, in particular sintered steel.

Thus, using sintered steel to produce the drum 23 makes it possible to decrease the resistance to rubbing of the helical spring 22 against the inner friction surface 27 of the housing 26 of the drum 23.

Owing to the present invention, the first and second radial retention elements of the input member and the cap respectively extending between the driving tooth and the spacer make it possible to guarantee the radial retention of the helical spring with respect to the input member, the output member and the cap, during the manufacturing of the spring brake and during the operation of the spring brake, as well as to reduce the operating noises of the spring brake, during the rotational driving of the input member and/or the output member inside the housing of the drum.

In this way, the first and second radial retention elements of the input member and the cap respectively extending between the driving tooth and the spacer make it possible to avoid manufacturing defects related to a misalignment of the helical spring with respect to the input member, the output member and the cap.

As a result, the first and second radial retention elements of the input member and the cap respectively extending between the driving tooth and the spacer make it possible to guarantee the positioning of the helical spring inside the housing of the drum, during the assembly of the spring brake and, more specifically, during a winding operation of the helical spring.

Furthermore, during the assembly of the spring brake, the first and second radial retention elements of the input member and the cap respectively extending between the driving tooth and the spacer make it possible to limit rubbing of the helical spring on the inner friction surface of the housing of the drum and therefore to avoid the withdrawal of at least part of a lubricant deposited on this inner friction surface and on the helical spring.

Many changes can be made to the example embodiment previously described without going beyond the scope of the invention defined by the claims.

In a variant, not shown, the electronic control unit 44 is positioned outside the casing 13 of the electromechanical actuator 11 and, in particular, mounted on the frame 20 or in the torque support 19.

Furthermore, the considered embodiments and alternatives may be combined to generate new embodiments of the invention, without going beyond the scope of the invention defined by the claims.

The invention claimed is:

1. An electromechanical actuator for a closure or sun protection home automation installation, the electromechanical actuator comprising at least:

an electric motor;
a reduction gear; and
a spring brake,
the spring brake comprising at least:
a helical spring,
a drum that comprises a housing, the housing of the drum comprising an inner friction surface configured to cooperate with at least one turn of the helical spring,
an input member,
an output member, and
a cap,
the input member comprising a driving tooth, the driving tooth extending between the input member and the cap, in an assembled configuration of the spring brake, and
the input member or the cap comprising a spacer, the spacer extending between the input member and the cap, in the assembled configuration of the spring brake,
wherein the input member comprises a first radial retention element configured for radially retaining the helical spring,
wherein, in the assembled configuration of the spring brake, the first radial retention element extends between the driving tooth and the spacer, along a first side of the spring brake,
wherein the cap comprises a second radial retention element configured for radially retaining the helical spring,
wherein, in the assembled configuration of the spring brake, the second radial retention element extends between the driving tooth and the spacer, along a second side of the spring brake, and
wherein the second side of the spring brake is opposite the first side of the spring brake, relative to an axis of rotation of the spring brake.

2. The electromechanical actuator for a closure or sun protection home automation installation according to claim 1, wherein the first and second radial retention elements each comprises a rib extending partially between the input member and the cap, along a direction of the rotation axis, in the assembled configuration of the spring brake.

3. The electromechanical actuator for a closure or sun protection home automation installation according to claim 1, wherein an outer surface of the first radial retention element and an outer surface of the second radial retention element are configured to cooperate with at least one turn of the helical spring.

4. The electromechanical actuator for a closure or sun protection home automation installation according to claim 1, wherein:
the helical spring is formed from a wire,
a first end of the helical spring forms a first tab,
a second end of the helical spring forms a second tab, and
each of the first and second tabs extends radially relative to the rotation axis and toward an inside of the helical spring.

5. The electromechanical actuator for a closure or sun protection home automation installation according to claim 4, wherein, in the assembled configuration of the spring brake, the first tab of the helical spring is configured to cooperate with a first surface of the driving tooth of the input member and wherein the second tab of the helical spring is configured to cooperate with a second surface of the driving tooth of the input member, the second surface of the driving tooth being opposite the first surface of the driving tooth.

6. The electromechanical actuator for a closure or sun protection home automation installation according to claim 5, wherein, in the assembled configuration of the spring brake, the first tab of the helical spring is positioned between the first surface of the driving tooth of the input member and the spacer and wherein the second tab of the helical spring is positioned between the second surface of the driving tooth of the input member and the spacer.

7. The electromechanical actuator for a closure or sun protection home automation installation according to claim 4, wherein:
the input member comprises a first plate,
the cap comprises a second plate, and
in the assembled configuration of the spring brake, the first tab of the helical spring extends along the second plate of the cap and the second tab of the helical spring extends along the first plate of the input member.

8. The electromechanical actuator for a closure or sun protection home automation installation according to claim 1, wherein the input member and the cap are kept secured in rotation around the rotation axis, in the assembled configuration of the spring brake.

9. The electromechanical actuator for a closure or sun protection home automation installation according to claim 8, wherein the input member and the cap are fastened to one another using fastening elements and wherein the fastening elements of the input member and the cap are configured to fasten by resilient snapping and are positioned at the driving tooth and the spacer.

10. The electromechanical actuator for a closure or sun protection home automation installation according to claim 2, wherein:
the helical spring is formed from a wire,
a first end of the helical spring forms a first tab,
a second end of the helical spring forms a second tab, and
each of the first and second tabs extends radially relative to the rotation axis and toward the inside of the helical spring.

11. The electromechanical actuator for a closure or sun protection home automation installation according to claim 3, wherein:
the helical spring is formed from a wire,
a first end of the helical spring forms a first tab,
a second end of the helical spring forms a second tab, and
each of the first and second tabs extends radially relative to the rotation axis and toward an inside of the helical spring.

12. The electromechanical actuator for a closure or sun protection home automation installation according to claim 5, wherein:
the input member comprises a first plate,
the cap comprises a second plate, and
in the assembled configuration of the spring brake, the first tab of the helical spring extends along the second plate of the cap and the second tab of the helical spring extends along the first plate of the input member.

13. The electromechanical actuator for a closure or sun protection home automation installation according to claim 6, wherein:
the input member comprises a first plate,
the cap comprises a second plate, and
in the assembled configuration of the spring brake, the first tab of the helical spring extends along the second plate of the cap and the second tab of the helical spring extends along the first plate of the input member.

14. The electromechanical actuator for a closure or sun protection home automation installation according to claim 2, wherein the input member and the cap are kept secured in rotation around the rotation axis, in the assembled configuration of the spring brake.

15. The electromechanical actuator for a closure or sun protection home automation installation according to claim 3, wherein the input member and the cap are kept secured in rotation around the rotation axis, in the assembled configuration of the spring brake.

16. The electromechanical actuator for a closure or sun protection home automation installation according to claim 4, wherein the input member and the cap are kept secured in rotation around the rotation axis, in the assembled configuration of the spring brake.

17. The electromechanical actuator for a closure or sun protection home automation installation according to claim 5, wherein the input member and the cap are kept secured in rotation around the rotation axis, in the assembled configuration of the spring brake.

18. The electromechanical actuator for a closure or sun protection home automation installation according to claim 6, wherein the input member and the cap are kept secured in rotation around the rotation axis, in the assembled configuration of the spring brake.

19. The electromechanical actuator for a closure or sun protection home automation installation according to claim 7, wherein the input member and the cap are kept secured in rotation around the rotation axis, in the assembled configuration of the spring brake.

20. A home automation installation for closing or providing sun protection, the home automation installation comprising:

an electromechanical actuator;

a winding tube; and a screen, wherein the screen is capable of being wound on the winding tube when rotated by the electromechanical actuator, wherein the electromechanical actuator includes at least:

an electric motor;

a reduction gear; and a spring brake, the spring brake comprising at least:

a helical spring, a drum that comprises a housing, the housing of the drum comprising an inner friction surface configured to cooperate with at least one turn of the helical spring, an input member, an output member, and a cap, the input member comprising a driving tooth, the driving tooth extending between the input member and the cap, in an assembled configuration of the spring brake, and the input member or the cap comprising a spacer, the spacer extending between the input member and the cap, in the assembled configuration of the spring brake, wherein the input member comprises a first radial retention element configured for radially retaining the helical spring, wherein, in the assembled configuration of the spring brake, the first radial retention element extends between the driving tooth and the spacer, along a first side of the spring brake, wherein the cap comprises a second radial retention element configured for radially retaining the helical spring, wherein, in the assembled configuration of the spring brake, the second radial retention element extends between the driving tooth and the spacer, along a second side of the spring brake, and wherein the second side of the spring brake is opposite the first side of the spring brake, relative to an axis of rotation of the spring brake.

* * * * *